US008579463B2

(12) United States Patent
Clough

(10) Patent No.: US 8,579,463 B2
(45) Date of Patent: Nov. 12, 2013

(54) MODULAR LIGHTING SYSTEM

(76) Inventor: Christian James Clough, Ames, IA (US)

( * ) Notice: Subject to any disclaimer, the term of this patent is extended or adjusted under 35 U.S.C. 154(b) by 193 days.

(21) Appl. No.: 13/212,553

(22) Filed: Aug. 18, 2011

(65) Prior Publication Data

US 2012/0049739 A1 Mar. 1, 2012

Related U.S. Application Data

(60) Provisional application No. 61/378,608, filed on Aug. 31, 2010.

(51) Int. Cl.
*F21V 21/00* (2006.01)

(52) U.S. Cl.
USPC ..... 362/217.13; 362/217.1

(58) Field of Classification Search
USPC ..... 315/224, 246, 247, 291; 362/217.01, 362/291, 255, 217.1, 217.11, 217.12, 362/217.13, 217.14, 249.01, 249.02, 249.06
See application file for complete search history.

(56) References Cited

U.S. PATENT DOCUMENTS

| | | | | |
|---|---|---|---|---|
| 5,944,410 | A * | 8/1999 | Chiou et al. | 362/259 |
| 2004/0037080 | A1* | 2/2004 | Luk et al. | 362/252 |
| 2004/0156199 | A1* | 8/2004 | Rivas et al. | 362/240 |
| 2004/0257006 | A1* | 12/2004 | Beeman et al. | 315/291 |
| 2008/0037239 | A1* | 2/2008 | Thomas et al. | 362/92 |
| 2008/0151535 | A1* | 6/2008 | de Castris | 362/220 |
| 2009/0073693 | A1* | 3/2009 | Nall et al. | 362/249.02 |
| 2009/0295311 | A1* | 12/2009 | Duerr et al. | 315/313 |

* cited by examiner

*Primary Examiner* — Minh D A
(74) *Attorney, Agent, or Firm* — McKee, Voorhees & Sease, P.L.C.

(57) ABSTRACT

An LED tube is provided for providing general illumination. The LED tube includes a tubular housing having a clear shield and a heat sink opposite the clear shield. A strip including LED lights, circuitry, and electrical hubs are positioned on the backside of the heat sink under the shield. The housing also includes first and second ends that include portions of a quarter turn locking system to allow multiple housings to be attached to one another for a longer string of lighting. A power source for powering the LED lights, and an end cap may also be attached to the first and second ends of the housing by the quarter turn locking system. The housing or housings may be connected to a wall or the like by the use of one or more clip mounts.

13 Claims, 8 Drawing Sheets

SWITCHING CONSTANT CURRENT CIRCUIT

MODULAR LIGHTING SYSTEM

CROSS-REFERENCE TO RELATED APPLICATIONS

This application claims priority under 35 U.S.C. §119 to provisional application Ser. No. 61/378,608 filed Aug. 31, 2010, herein incorporated by reference in its entirety.

FIELD OF THE INVENTION

The present invention generally relates to a lighting strip for providing general illumination. More particularly, but not exclusively, the invention relates to a lighting tube containing a strip of LED lights that can be easily attached to like tubes to provide for varying amounts and lengths of light.

BACKGROUND OF THE INVENTION

Light emitting diode (LED) lights, and more particularly, groups of LED lights, are currently used to illuminate a variety of areas. The lights are placed in clusters to provide a specifically oriented ray of light, as with a flashlight, or they are added to strips for illuminating a larger, more generalized area. Although a number of LEDs are needed to produce enough light to illuminate a desired area, LEDs do not require as much energy as standard lighting, and are more efficient than incandescent bulbs. In addition, LEDs have a much longer lifetime than either fluorescent or incandescent bulbs. The lifetime is generally three to four times longer than fluorescent tubes, and twenty-five to thirty times longer than incandescent bulbs. Additionally, the on/off time and the efficiency of LEDs are better than fluorescent or incandescent lights.

However, there are some disadvantages to using LEDs. It may be difficult to wire the LEDs together. LEDs are also voltage sensitive. LEDs must be supplied with the voltage above the threshold and a current below the rating. This can involve series resistors or current-regulated power supplies. It is also difficult to find the correct power source that correctly powers the LEDs, but that is also practical to use with the application of the light source. Therefore, it is not practical to buy LEDs to put together for use in everyday applications. In addition, it may be difficult to determine the correct amount of LEDs to use for a particular application.

Accordingly, there is a need in the art for a lighting system that incorporates LED lights in a convenient manner that is neither expensive nor complex. There is also a need in the art for an LED casing that allows for the easy addition of more light strips, as well as easy connectivity to a power source.

SUMMARY OF THE INVENTION

It is therefore a primary object, feature, and/or advantage of the present invention to overcome deficiencies in the art.

It is another object, feature, and/or advantage of the present invention to provide a general purpose LED tube containing a pre-wired strip of LEDs.

It is yet another object, feature, and/or advantage of the present invention to provide an LED tube that can be used in any combination of light and spectral distribution.

It is still another object, feature, and/or advantage of the present invention to provide an LED tube that can be connected to multiple power supplies.

It is another object, feature, and/or advantage of the present invention to provide an LED tube that can be quickly and easily coupled to additional LED tubes.

It is another object, feature, and/or advantage of the present invention to provide an LED tube that includes an end that can snap into power supplies.

It is another object, feature, and/or advantage of the present invention to provide an LED tube that includes a locking system used for mounting the tube.

It is another object, feature, and/or advantage of the present invention to provide an LED tube designed for low power consumption.

These and/or other objects, features, and advantages of the present invention will be apparent to those skilled in the art. The present invention is not to be limited to or by these objects, features and advantages, and no single embodiment need exhibit every object, feature, and/or advantage.

The present invention generally comprises a general purpose light-emitting diode (LED) tube designed to provide general illumination. The LED tube includes a circular housing, a heat sink, a plurality of LEDs, circuitry, and first and second opposite housing ends. The circular housing also includes an acrylic shield that can be modified to produce varying light distribution. The first and second housing ends generally comprise a quarter turn locking system, and may also include plug connectors for connecting one of the ends of the housing to a power source for powering the LEDs. The quarter turn locking system also allows multiple LED tubes to connect to one another sequentially to form a longer lighting system.

According to one aspect of the present invention, an LED tube is provided. The tube includes a first housing having opposite first and second ends. A plurality of LEDs is mounted in the housing. A power source is removably coupled to the first end of the housing, and electrical circuitry is included in the housing to control operation of the LEDs.

According to another aspect of the invention, an LED tube is provided. The tube includes a tubular housing having a clear shield and a heat sink opposite the shield, the housing further comprising opposite first and second ends. A strip is positioned at the backside of the heat sink within the housing, with the strip including a plurality of LED lights operatively connected to circuitry. An electrical hub is positioned on the strip at the first and second ends of the housing, and a power source is operatively connected to the electrical hub at the first end of the housing to power the LED lights through the circuitry.

According to yet another aspect of the present invention, a tube of LED light housings is provided. The tube includes a first housing having opposite first and second ends. The first housing includes a plurality of LED lights operatively connected to circuitry including an electrical hub at both the first and second ends of the first housing. A power source is operatively connected to the electrical hub at the first end of the first housing. A second housing having opposite first and second ends is operatively connected to the second end of the first housing. The second housing includes a plurality of LED lights operatively connected to circuitry. The power source provides power to illuminate the LED lights of both the first and second housings.

DETAILED DESCRIPTION OF THE PREFERRED EMBODIMENTS

The present invention will be described as it applies to its preferred embodiment. It is not intended that the present invention be limited to the described embodiment. It is intended that the invention cover all modifications and alternatives that may be included within the spirit and scope of the invention.

Figure 1:
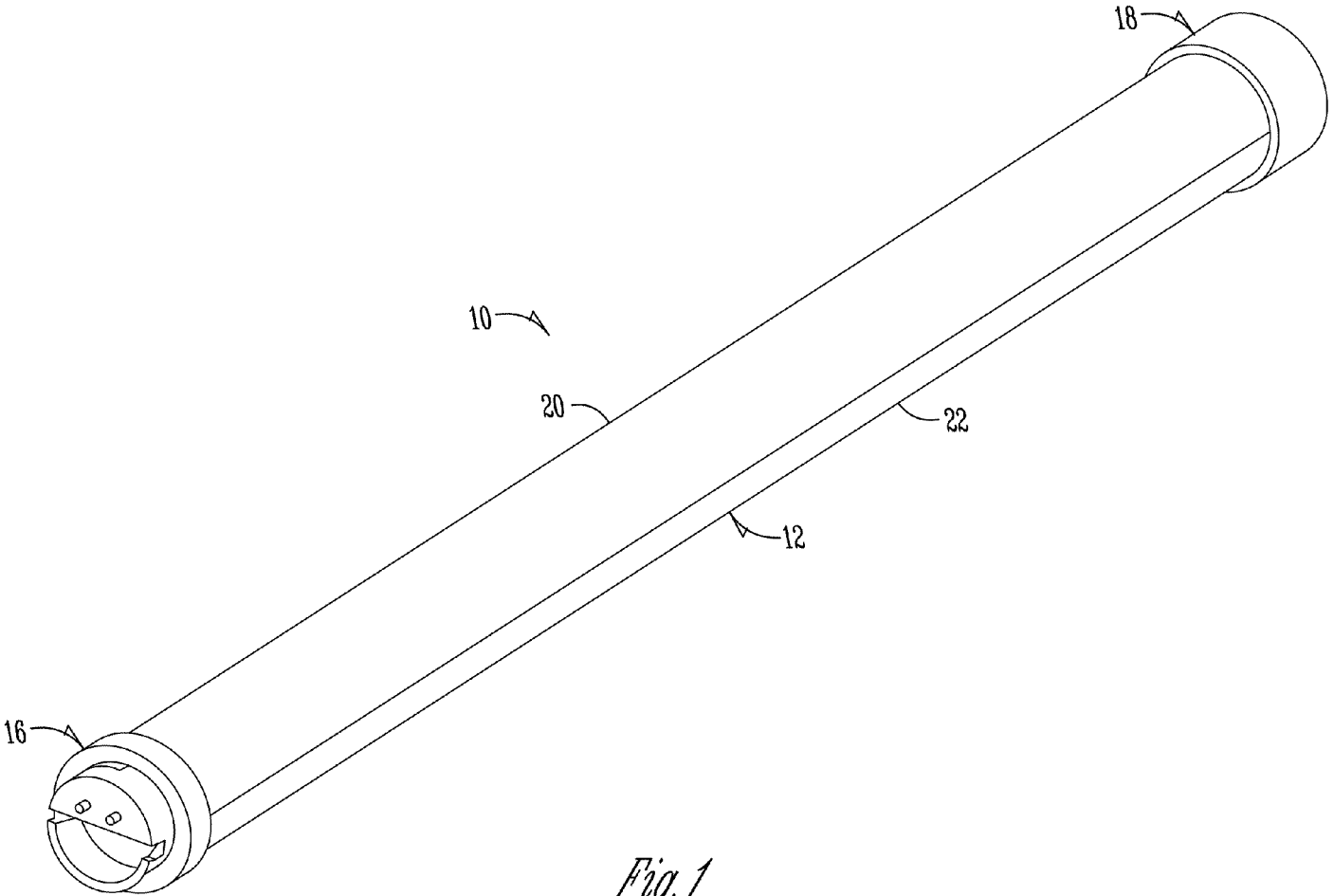
FIG. 1 is perspective view of an LED tube of the present invention showing the ends and housing of the tube.

FIG. 1 shows a general purpose light-emitting diode (LED) tube 10 designed for general illumination. The LED tube can be used with any combination of light and spectral distribution. The tube is designed for low power consumption and can be powered by any power source. Examples of power sources for use with the LED tube are switching power supplies, offline supplies, battery packs, and solar power. However, it should be appreciated that these are just examples of power sources, and any power source may be used with the LED tube.

The LED tube comprises a tubular housing 12, an LED strip 14, a first end or plug connector 16, and a second end or jack close 18. The tubular housing includes a shield 20 and a heat sink 22. Approximately half of the housing is a shield. The shield may be comprised of an acrylic modified to produce varying light distribution. For example, the curvature of the shield may be modified to increase or decrease the angle of light distribution. In the embodiment shown, the range of light distribution is approximately 120°. In addition, the shield may be colored to produce different lighting effects. The heat sink 22, which comprises approximately half of the circular housing, is comprised of aluminum and is used to passively cool each of the LEDs to maintain acceptable operating temperatures. It should be appreciated that any material capable of acting as a heat sink is included in the scope of the invention, however.

While the shape of the housing is generally shown to be tubular or circular in cross-section, it should be appreciated that any shape may be used to house the heat sink and led lights. For instance, the housing may be square or have a non-symmetrical cross-section. In addition, as shown in the figures, the heat sink may be star-shaped or have a shape with a non-symmetrical cross-section. The invention is not to be limited to the shape of the housing or heat sink, and the shapes shown are merely examples.

Figure 2:
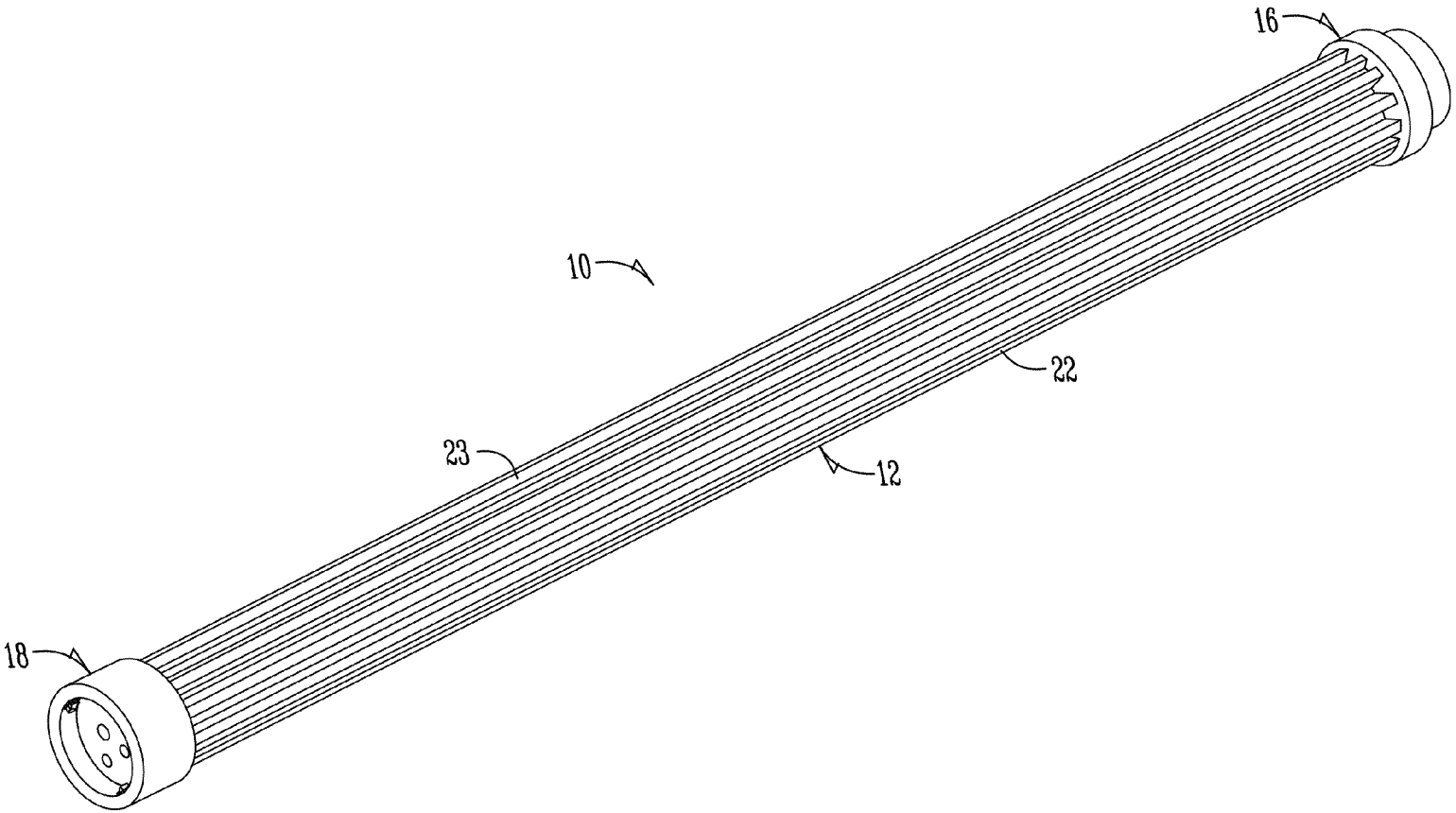
FIG. 2 is perspective view of the LED tube showing the ends and the heat sink.

FIG. 2 is a perspective view of the LED tube showing the opposite side of the circular housing of FIG. 1. FIG. 2 shows the heat sink 22 of the LED tube 10. As shown in FIG. 2, the heat sink 22 may comprise a plurality of ridges or channels 23. These ridges or channels 23 increase the surface area of the heat sink 22 to aid in dissipating heat from the LEDs.

Figure 3:
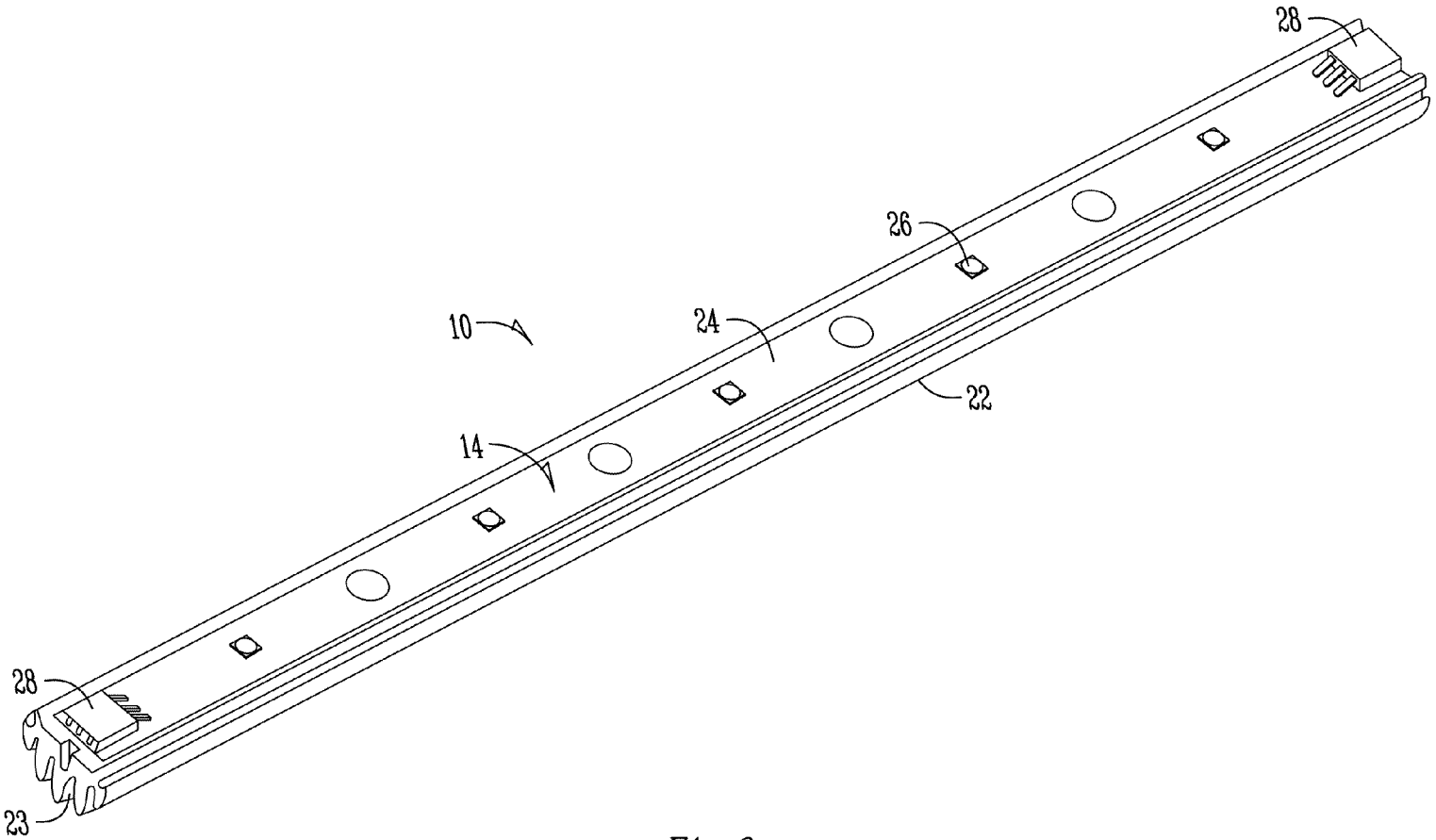
FIG. 3 is a perspective view of a strip of LEDs used with the LED tube of the present invention.

FIG. 3 is a perspective view of the LED tube 10 without the shield member 20 or the first and second ends 16, 18. FIG. 3 shows the strip 14 of LEDs 26 positioned on a thermally conductive substrate strip 24 on the backside of the heat sink 22. The plurality of LEDs 26 is connected to circuitry 27. The circuitry 27 ensures that the LEDs operate at the proper voltage so that the lights do not burn out. Located at each end of the LED strip 14 are electrical hubs 28, which contain wiring and other circuitry for connecting the LED tube 10 to a power source. The electrical hubs 28 also contain wiring and circuitry to connect one LED tube to another LED tube to create a longer string of lighting. The LEDs 26 are standard LEDs that form the LED assembly. The LEDs are connected to a circuit in each tube to maintain constant current. However, intensity of the lights may be controlled using a low side switch and pulse width modulation.

Figure 4:
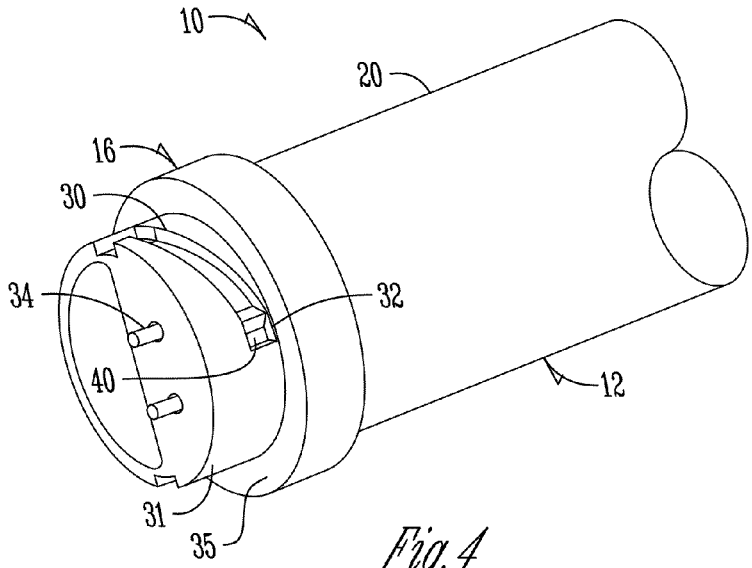
FIG. 4 is an enlarged view of a first end of the LED tube including compression contacts for electronically connecting the tube.

FIG. 4 is an enlarged view of the first end 16 of the LED tube 10. The first end 16 may also be called the plug connector. The first end 16 and the second end 18 of the LED tube 10 are configured to be connected to one another, as will be discussed below. However, FIG. 4 shows that the plug connector 16 includes grooves or slots 30 and a locking portion 32 at the end of the groove to aid in the connection and locking of two tubes. The plug connector 16 also includes a flanged portion 35, which is used as a stop member to aid in connecting the two light strips or power source. Each plug connector 16 includes spring compression contacts 34, which transfer power to the mating jack. The jack contains oversized contacts that connect to opposite plug pins in the second end of the LED tube 10.

Figure 5:
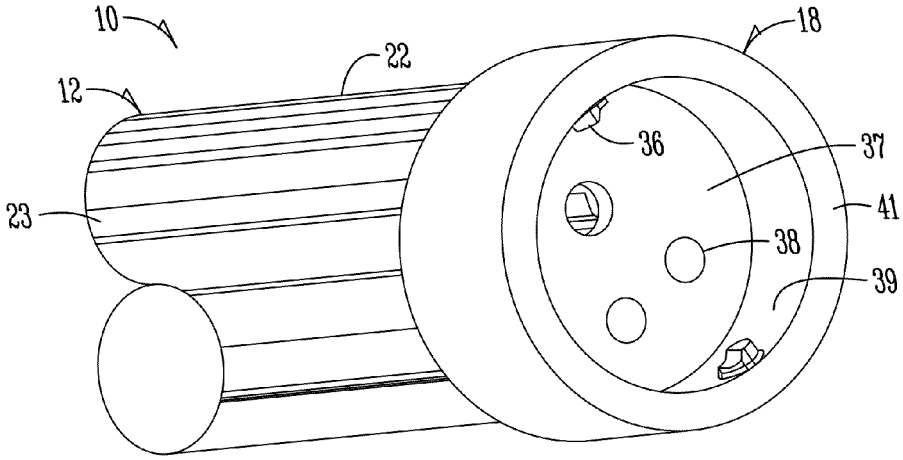
FIG. 5 is an enlarged view of a second end of the LED tube.

FIG. 5 is an enlarged view of the second end or jack close 18 of the LED tube 10. The second end 18 of the LED tube is configured to receive and connect to the first end 16 of a different LED tube. As shown in FIG. 5, the second end 18 of the LED tube 10 includes multiple extrusions 36 extending from an inner wall 39 of a recessed portion 37 of the second end 18. These extrusions 36 are configured to align with the grooves or slots 30 and locking portion 32 of the first end 16 of another LED tube. The second end 18 of the LED tube also includes receiving apertures 38 for receiving the contacts 34 of the first end 16. The front face 41 of the second end 18 is sized to be mate with the flange 35 of the first end 16. The first and second ends may be comprised of a plastic or rubber material, or any other material that is not electrically conductive.

Figure 6:
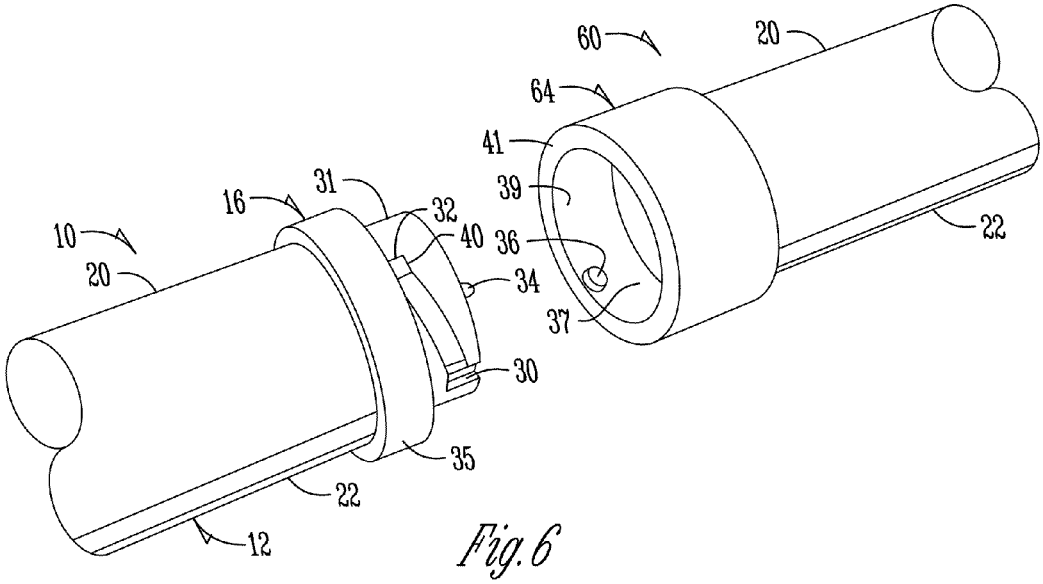
FIG. 6 is a perspective view of two LED tubes showing how the first end of one tube is able to lock into and connect to a second end of another tube.

FIG. 6 is a perspective view of a first end 16 of a first LED tube 10 being connected to a second end 64 of a second LED tube 60. As the first and second LED tubes are brought together, the extrusions 36 of the second end 64 of the second tube 60 are aligned with slots 30 in the outer wall 31 of the first end 16 of the first tube. The extrusions 36 are slid into the openings of the slots 30 as the two tubes are brought together axially about a common central axis. It is noted that in this initial position, the contacts 34 are not aligned with the holes 38, but rather are depressed by their spring-loaded construction. Once the extrusions 36 have encountered the end of the slots, the first and second tubes are rotated in opposite directions (clockwise) relative to one another. The rotation causes the extrusions 36 to slide along the grooves 30 in the first end 16 until the extrusions are adjacent the locking portion 32. The locking portion 32 of the first end 16 is essentially a recess 40 at the end of the grooves 30. The extrusions 36 will drop into the recessed locking portions 32 to lock the first tube to the second tube. The rotation is approximately a quarter turn locking system, which requires the tubes to be rotated approximately 90° in relation to each other. At this point, the contacts 34 of the first end 16 of the first tube will spring out or extend into the holes 38 of the second end 64 of the second tube to create an electronic connection through the two tubes. The quarter turn locking system allows two LED tubes to be connected or disconnected quickly and easily.

To disconnect the two tubes, a rotational force should be applied to the two members in a counterclockwise direction. The extrusions 36 will be forced from the recess 40, and can be rotated along the grooves 30 of the first end 16 until it reaches the slot. At this point, the first and second tubes are pulled apart along a common axis to separate the first tube from the second tube. Because of the domed shape of the contacts, they will be depressed into the plug connector until the two LED tubes are disconnected. In addition, the holes may contain ramps to aid in the depression of the contacts when the tubes are being rotated to disconnect.

Figure 7:
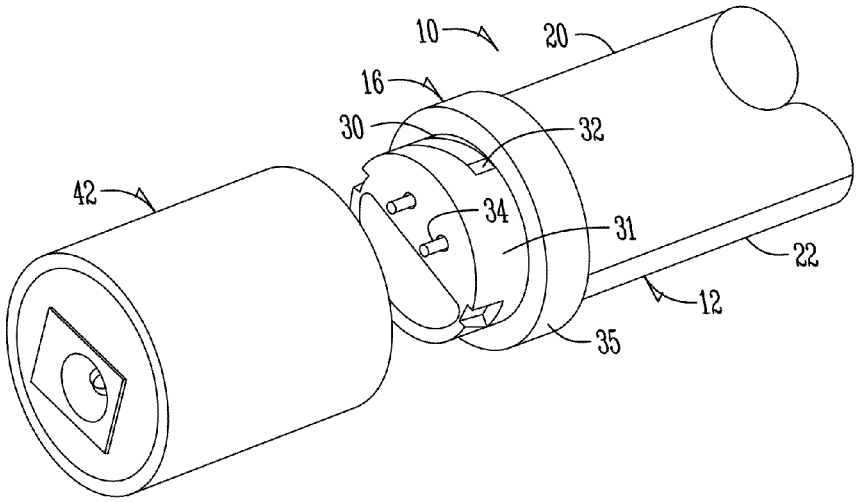
FIG. 7 is an enlarged view of the first end of the LED tube being connected to a power source.

FIG. 7 is an enlarged view of an LED tube 10 being connected to a power source or power pack 42. The power pack 42 may be any power source, including, but not limited to, a battery pack, a solar power pack, or the like. The inside of the power pack 42 includes a set of extrusions, identical to the extrusions of the second end 18 of the LED tube. Therefore, the power pack 42 is connected to the first end 16 of the LED tube 10 in the same manner that the first end of the LED tube is connected to the second end of another LED tube. This includes connecting, rotating, and locking the power pack and the LED tube to one another. However, in this connection, the contacts of the first end of the LED tube connect to contacts of the power pack. The power pack is able to power the LED strip such that the LEDs are able to illuminate light. The quarter turn locking system between the LED tube and the power pack allows the power pack to be added or removed quickly and easily such that the power pack can be replaced when necessary or desired. Therefore, the type of power pack or power source 42 can be changed depending on the use of the LED tube 10 and the external environment around the LED tube.

Figure 8:
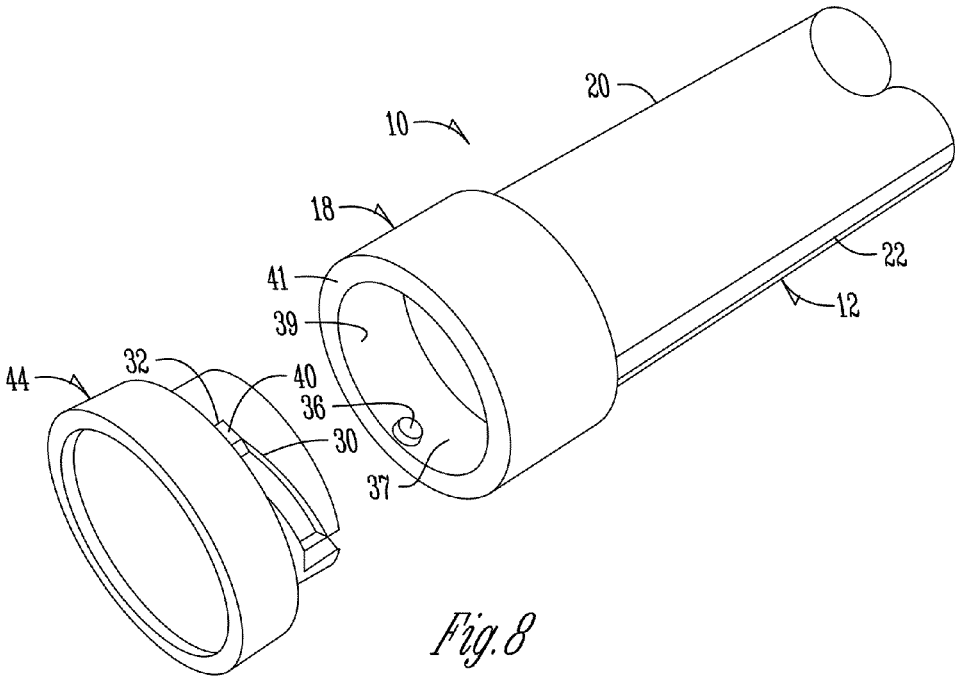
FIG. 8 is an enlarged view of the second end of the LED tube being connected to an end cap.

FIG. 8 is an enlarged view of the second end 18 of an LED tube 10 being connected to an end cap 44. The end cap 44 includes the slots, grooves, and recess similar to the first end 16 of an LED tube. Therefore, the end cap 44 is connected and locked to the second end 18 of the LED tube in the same way that the first end of the LED tube is connected to the second end of another LED tube, as discussed above. The end cap is comprised of a non-conductive material, such that electricity is not passed into the end cap. The cap may be used with the end LED tube so that external environments do not damage the electrical components and LEDs of the LED tube 10. The quarter turn locking system of the LED tubes and end caps allow the caps to be added and removed quickly and easily.

Figure 9:
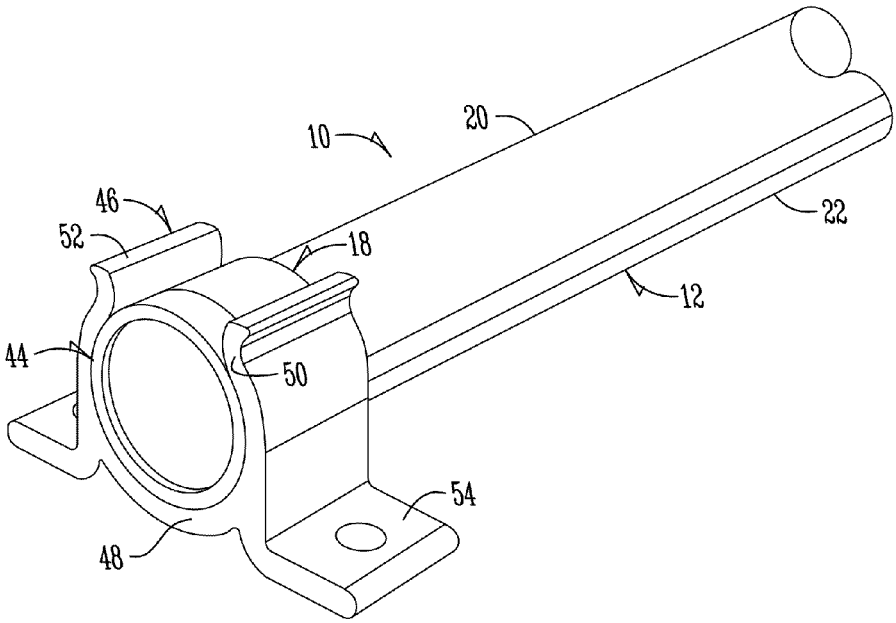
FIG. 9 is an enlarged view of the LED tube showing the second end and end cap secured to a clip mount.

FIG. 9 is an enlarged view of the second end 18 and end cap 44 of an LED tube 10 secured to a clip mount 46. The end cap 44 is connected to and locked to the LED tube 10 as described above. The clip mount 46 may be secured to a casing, wall, fixture, or the like to mount at least one LED tube. The clip mount 46 may be secured or connected by glue, solvent, magnets, or screws. However, it should be appreciated that the clip mount may be connected as required by the material to which it is being mounted. The clip mount 46 includes a circular portion 48 having a cutout arc 50 with flared ends 52, and outwardly extending members 54 for securing the clip to an object. The cut out arc 50 is generally narrower than the diameter of the end cap 44 and second end 18 of the LED tube 10. Therefore, to clip a tube to the clip mount, the end cap and second end are pressed towards the circular portion 48 of the clip mount through the flared ends 52. The end cap 44 and second end 18 will essentially snap fit into connection with the clip mount 46. Additional clip mounts may be used at connections between multiple LED tubes or at the opposite end of a string of LED tubes to support the LED tubes along the object being mounted to. This allows the LED tubes to be mounted to different objects in any desired orientation to best illuminate an area. It should also be appreciated that the clip mounts may be made of a plastic material, a metal material, or any other semi-rigid material capable of supporting the LED tube or string of tubes.

Figure 10:
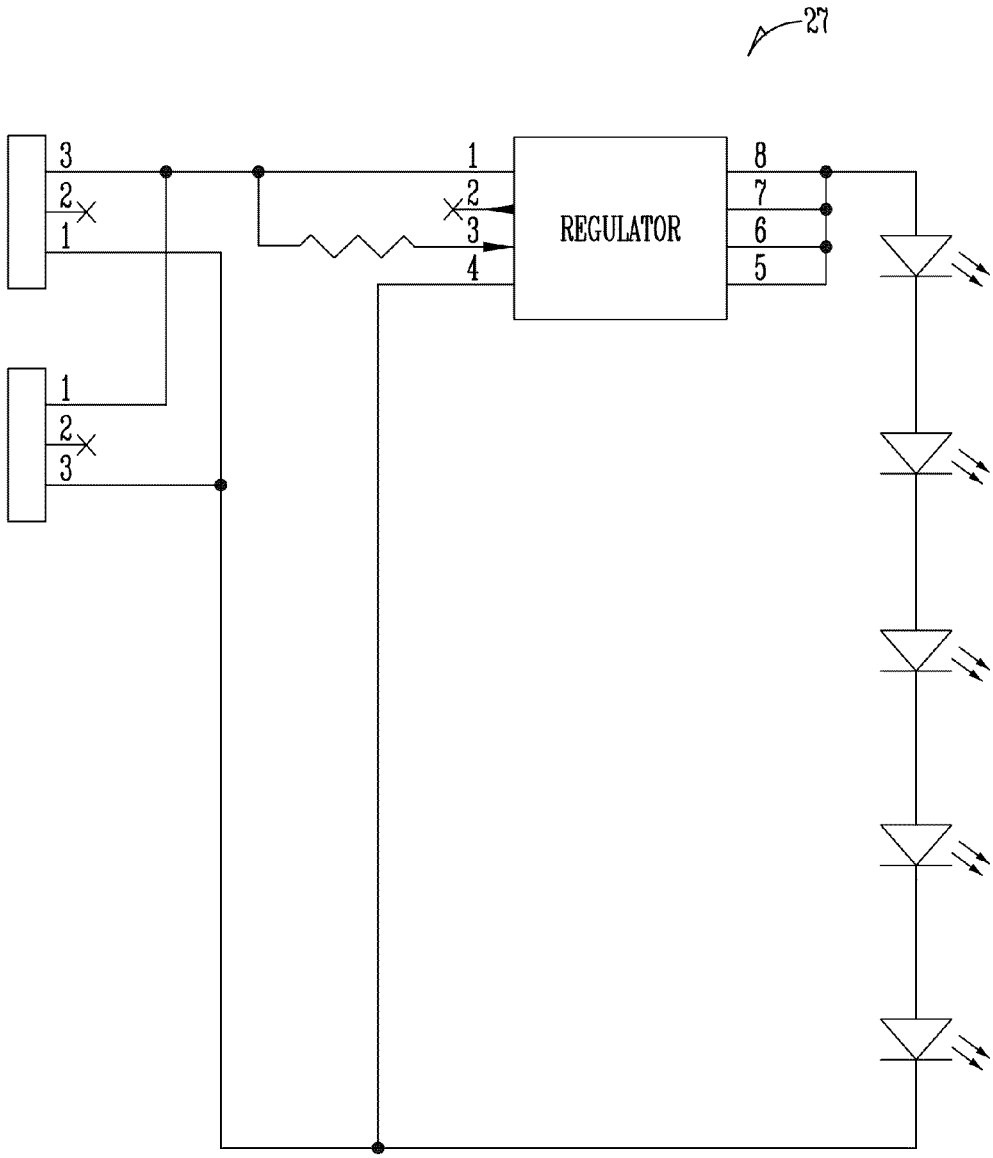
FIG. 10 is a schematic of a linear constant current circuit used with the LED tube of the present invention.

FIG. 10 is a schematic view of a linear constant current circuit 27 used with the LED tube 10 of the present invention. The circuit 27 provides continuously variable regulated current from a power source 42. The circuit includes a power source, at least one resistor, and a regulator in connection with a plurality of LEDs. This circuit ensures that the LEDs will be powered with the proper amount of voltage such that they will not burn out.

Figure 11:
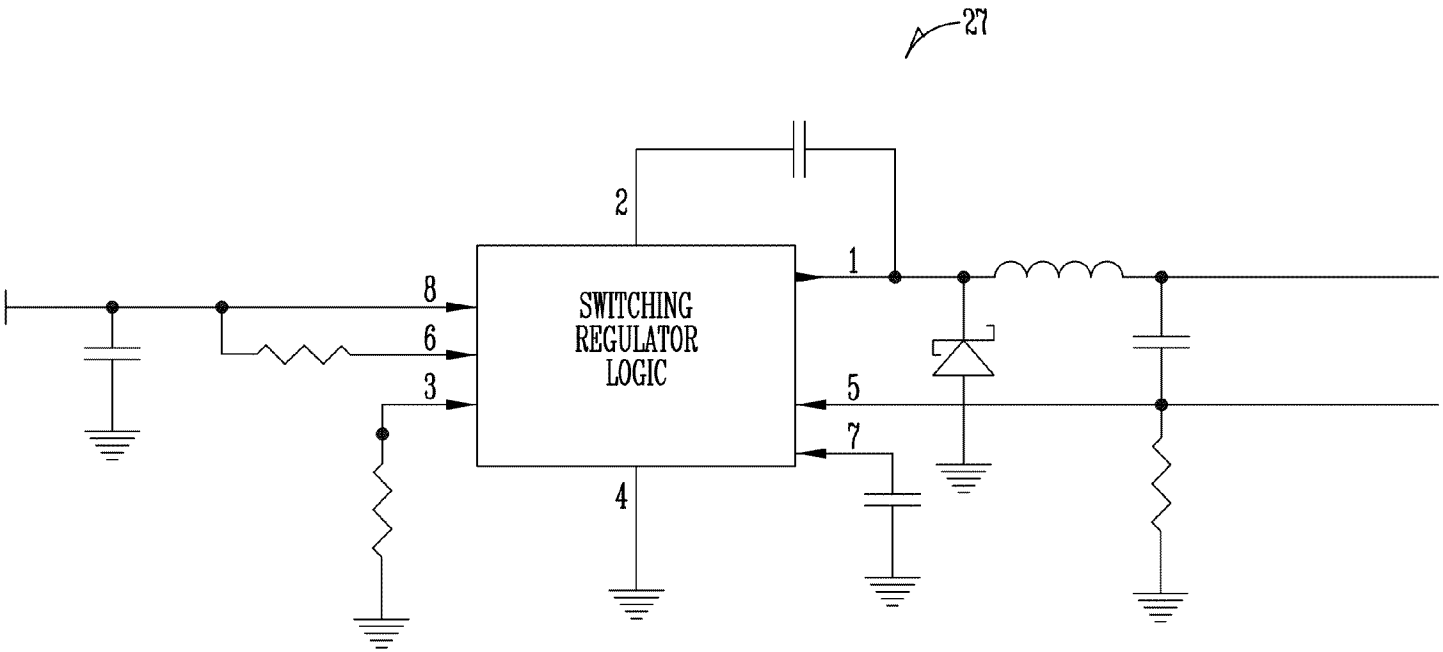
FIG. 11 is a schematic of a switching constant current circuit used with the LED tube of the present invention.

FIG. 11 is a schematic view of a switching constant current circuit 27 used with the LED tube of the present invention. The circuit includes a power source, a plurality of resistors, a plurality of capacitors, an inductor, a switching regulator logic, a Schottky diode, and a plurality of grounds.

A general description of the present invention as well as a preferred embodiment of the present invention has been set forth above. Those skilled in the art to which the present invention pertains will recognize and be able to practice additional variations in the methods and systems described which fall within the teachings of this invention. Accordingly, all such modifications and additions are deemed to be within the scope of the invention, which is to be limited only by the claims appended hereto.

What is claimed is:

1. An LED tube, comprising:

a first housing having opposite first and second ends, wherein the first end comprises at least one spiral shaped groove positioned at least partially around an outer wall of the first end and ending at a recess, an electrical contact extending from the first end, and a flange portion extending at least partially radially about the first end;

a plurality of LEDs mounted in the housing;

a power source removably coupled to the first end of the housing; and electrical circuitry in the housing to control operation of the LEDs.

2. The LED tube of claim 1 further comprising a second housing with a plurality of LEDs electrically coupled to the first end of the first housing.

3. The LED tube of claim 1 wherein the first housing includes both a shield and a heat sink.

4. The LED tube of claim 3 wherein the heat sink comprises a plurality of channels.

5. The LED tube of claim 1 wherein the second end comprises a recessed portion having an inner wall and a front face, at least one extrusion extending from the inner wall, and an aperture for receiving the electrical contact of the first end.

6. The LED tube of claim 5 wherein the front face of the second end is adapted to abut against a flange portion of a first end of a second housing when a first and second housing are coupled together.

7. The LED tube of claim 1 further comprising at least one electrical hub positioned in the housing and operatively connected to the plurality of LEDs.

8. The LED tube of claim 1 wherein the power source is a battery pack.

9. The LED tube of claim 1 further comprising an end cap operatively connected to the second end.

10. The LED tube of claim 1 further comprising at least one clip mount attached to the tube and adapted to mount the tube.

11. The LED tube of claim 1 wherein the electrical circuitry comprises a linear constant current circuit.

12. The LED tube of claim 1 wherein the electrical circuitry comprises a switching constant current circuit.

13. A plurality of LED light housings, comprising:

a first housing having opposite first and second ends, the first housing including a plurality of LED lights operatively connected to circuitry including an electrical hub at both the first and second ends of the first housing;

a power source operatively connected to the electrical hub at the first end of the first housing;

a second housing having opposite first and second ends, the second housing including a plurality of LED lights operatively connected to circuitry and the first end of the second housing operatively connected to the second end of the first housing;

a quarter turn locking system connecting the second end of the first housing to the end of the second housing: and the power source providing power to illuminate the LED lights of both the first and second housings.

* * * * *